US006510595B2

(12) United States Patent
Matsushima et al.

(10) Patent No.: US 6,510,595 B2
(45) Date of Patent: Jan. 28, 2003

(54) MESHING SLIDE FASTENER WITH AN ENGAGING DEVICE

(75) Inventors: Hideyuki Matsushima, Toyama-ken (JP); Hiroshi Mori, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/866,751

(22) Filed: May 30, 2001

(65) Prior Publication Data

US 2001/0047574 A1 Dec. 6, 2001

(30) Foreign Application Priority Data

May 31, 2000 (JP) ..... 2000-161596

(51) Int. Cl.[7] ..... A44B 19/10
(52) U.S. Cl. ..... 24/433; 24/399; 24/400
(58) Field of Search ..... 24/433, 435, 427, 24/400, 399, 585.1, DIG. 50

(56) References Cited

U.S. PATENT DOCUMENTS

| | | | | | |
|---|---|---|---|---|---|
| 2,989,791 | A | * | 6/1961 | Morin | 24/433 |
| 3,790,993 | A | * | 2/1974 | Gilles et al. | 24/433 |
| 4,139,927 | A | | 2/1979 | Heimberger | |
| 4,199,845 | A | * | 4/1980 | Ausnit | 24/399 |
| 5,653,002 | A | * | 8/1997 | Ishihara et al. | 24/399 |
| 6,088,888 | A | * | 7/2000 | Oda | 24/433 |
| 6,220,754 | B1 | * | 4/2001 | Stiglic et al. | 24/399 |

FOREIGN PATENT DOCUMENTS

| | | | | |
|---|---|---|---|---|
| CH | 0386152 | * | 4/1965 | 24/400 |
| GB | 0681941 | * | 10/1952 | 24/400 |
| GB | 1047928 | * | 11/1966 | 24/400 |
| GB | 1197270 | * | 7/1970 | 24/399 |
| IT | 0523995 | * | 7/1957 | 24/399 |
| JP | 30-443 | | 1/1930 | |
| JP | 48-36003 | | 10/1973 | |
| WO | WO 92/21260 | | 12/1992 | |

OTHER PUBLICATIONS

U.K. Search Report Application No. GB 0113077.2 dated Oct. 5, 2001.

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

A concave row and a convex row of a meshing slide fastener are molded of resin having plasticity. The convex row has a terminal end where slider guide portions for guiding a slider are removed. A convex-row-meshing portion of the convex row is inserted through a side of the slider so as to be engaged with a concave-row-meshing portion of the concave row. An engaging device including a female fastening member and a male fastening member is attached to terminal ends of the concave row and the convex row. In operation, the female fastening member of the engaging device on a side of the convex row is engaged with the male fastening member of the engaging device on the side of the concave row. After the slider is made to contact with the engaging device on the side of the concave row, the convex row is rotated with respect to the female fastening member and the male fastening member and inserted between guide flanges of the slider, so that the concave-row-meshing portion and the convex-row-meshing portion are meshed with each other by sliding of the slider. By conducting an inverse operation, the meshing is released so that the concave row and the convex row are separated from each other. Therefore, the meshing slide fastener with an engaging device can be meshed with and separated from each other by a simple operation.

11 Claims, 12 Drawing Sheets

MESHING SLIDE FASTENER WITH AN ENGAGING DEVICE

BACKGROUND OF THE INVENTION

1. Field of the Invention

The present invention relates to a slide fastener with water/air tightness, having a pair of concave row convex rows formed of thermoplastic resin adapted to mesh with each other, which is generally called a rail-shaped fastener. More particularly, it relates to a meshing type slide fastener, wherein an engaging device or an opening device is provided at the respective end portions of the concave row and the convex row so as to enable right and left parts thereof to be separated, and by engagement of the engaging device and sliding of a slider, the concave row and the convex row can be meshed with each other.

2. Description of the Related Art

FIG. 14 shows a conventional slide fastener having a pair of concave and convex rows 1', 2' made of thermoplastic resin, which is disclosed in Japanese Utility Model Publication No. 48-36003. As shown in FIG. 14, in the slide fastener, end portions of the pair of meshing concave row 1' and convex row 2' disposed on the right and left sides are fixed with a metal stop device 20' while the concave and convex rows 1', 2' are meshed with each other.

FIG. 15 shows another conventional meshing-type slide fastener having a pair of concave/convex and convex/concave meshing rows 1", 2", each having a plurality of hook pieces made of thermoplastic resin on one surface thereof, which is disclosed in Japanese Utility Model Publication No. 30-443. In the slide fastener, a box-shape metal stop device 20" is attached to an end portion of one of the meshing rows 1", 2", and a projection for preventing a slip-out of a slider is formed integrally at the other end portion. The end portion of the one of the meshing rows 1", 2" on which the box-shape metal stop device 20" is attached and the end portion of the other meshing row which is to be inserted into the box-shape metal stop device 20" are formed in a flat shape. Then, the other meshing row is inserted into the box-shape metal stop device 20", so that by sliding the slider, the both meshing rows 1", 2" can be meshed with and separated from each other.

The meshing type slide fastener of the first example as shown in FIG. 14 is a generally known one. Because the pair of concave and convex rows 1', 2' disposed on the right and left of the slide fastener are fixed by the metal stop device 20' attached to the end portions while being in a meshing condition, the pair of meshed concave and convex rows 1', 2' cannot be separated completely. Therefore, there is a problem that its usage field is limited, so that this meshing type slide fastener cannot be used for clothes which is to be separated to right and left sections to be opened completely.

In the meshing type slide fastener of the second example as shown in FIG. 15, the box-shape metal stop device 20" is attached to the end portion of one of the meshing concave/convex and convex/concave rows 1", 2", each of which has a plurality of hook pieces, and the other meshing row is inserted into this box-shape fastening metal, so that the both meshing rows 1", 2" are meshed with each other. However, an operation for separating the right and left meshing rows 1", 2" is very complicated, so that smooth separation or meshing operation can not be achieved. Therefore, this meshing type slide fastener is far from being practical.

SUMMARY OF THE INVENTION

Accordingly, the present invention has been achieved in views of the above-described problems. An object of a first aspect of the present invention is to provide a meshing type slide fastener with an engaging device comprised of a pair of concave and convex rows of thermoplastic resin, which are adapted to be meshed with each other, in which the pair of concave and convex rows can be separated from or meshed with each other easily and smoothly by sliding of a slider. This slide fastener also has an engaging device provided integrally at terminal ends of the respective concave and convex rows for facilitating engagement and separation of the rows, so that the convex row can be inserted through a side of the slider or released therefrom.

In addition to the object of the first aspect, an object of a second aspect of the present invention is to provide a slide fastener with an engaging device, which has a specific configuration of a concave-row-meshing portion and a convex-row-meshing portion capable of exerting their function efficiently, so as to open or close the pair of concave and convex rows by the sliding of the slider and to enable insertion of the convex row through a side of the slider and meshed with the concave row or separated therefrom, thereby achieving a smooth operation of the slide fastener.

In addition to the object of the first or the second aspect, an object of a third aspect of the present invention is to provide a slide fastener with an engaging device in which the convex-row-meshing portion of the convex row can be inserted into the concave-row-meshing portion of the concave row easily through the side of the slider, so that a meshing function without any lost action can be achieved with the slider.

In addition to the object of the first aspect, an object of fourth and fifth aspects of the present invention is to provide a slide fastener with an engaging device in which the engaging device having female and male fastening members, which allow the end portions of the pair of concave and convex rows to be engaged with and separated from each other, is molded integrally with the pair of concave and convex rows by injection molding, thereby achieving effective production of the slide fastener.

In addition to the object of the first aspect, an object of the fourth and sixth aspects of the present invention is to provide a slide fastener with an engaging device which has a specific configuration of the engaging device to be attached onto the end portions of the pair of concave and convex rows, and in which the engaging device is capable of being attached to a concave-row-supporting portion and a convex-row-supporting portion firmly, and is provided with a female fastening member and a male fastening member that can be engaged with and separated from each other. The engaging device is welded, bonded or joined by pressing to each of the concave row and the convex row by simple means.

In addition to the object of the fourth aspect, an object of a seventh aspect of the present invention is to provide a slide fastener with an engaging device which has a structure for engaging the engaging device of the concave row with that of the convex row thereby achieving meshing between the concave row and the convex row more accurately.

In addition to the object of fourth, an object of an eighth aspect of the present invention is to provide a slide fastener with an engaging device which has a specific configuration of the female and male fastening members to be equipped on the engaging device so as to enhance coupling/separation function of the engaging device thereby improving the quality and function of the fastener.

In addition to the object of the fourth, an object of a ninth aspect of the present invention is to provide a slide fastener with an engaging device in which the engaging device are fixed to the end portions of the pair of concave and convex rows firmly by injection molding thereby having firm attaching strength.

In addition to the object of the fourth or the sixth aspect, an object of a tenth aspect of the present invention is to provide a slide fastener with an engaging device in which the engaging device to be attached onto the end portions of the pair of concave and convex rows are formed of thermoplastic resin so that they can be attached on the end portions of the pair of concave and convex rows accurately and easily without obstructing their meshing operation.

In addition to the object of the fourth or the sixth aspect, an object of an eleventh aspect of the present invention is to provide a slide fastener with an engaging device in which the engaging device to be attached on the end portions of the pair of concave and convex rows are formed of metal and can be attached on the end portions of the pair of concave and convex row accurately and easily without obstructing their meshing operation.

In addition to the object of the first or the second aspect, an object of a twelfth aspect of the present invention is to provide a slide fastener with an engaging device, which has a specific configuration of the slider to be used for the meshing type slide fastener wherein the pair of concave and convex rows are meshed with each other, and which allows one of the rows to be inserted through a side of the slider and exerts its function accurately and effectively, thereby achieving a smooth opening/closing operation for the slide fastener.

To achieve the above objects, according to the first aspect of the present invention, there is provided a slide fastener with an engaging device, which is comprised of a concave row and a convex row made of thermoplastic resin, the concave row and the convex row being meshed with each other, wherein at least one slider guide portion of the convex row, which guides a slider, at a terminal end of a meshing portion of the concave row and the convex row is removed so that the convex-row-meshing portion is inserted through a side of the slider so as to be engaged with the concave-row-meshing portion, while the engaging device for allowing engagement and disengagement of terminal ends of the concave row and the convex row is disposed integrally to the concave row and the convex row.

Further, according to the second aspect of the present invention, there is provided a slide fastener with an engaging device wherein the concave-row-meshing portion has a hook-shaped engaging piece directed inward on tip ends of both sides or on a tip end of a single side thereof so that a fitting concave portion capable of fitting to the convex-row-meshing portion of the convex row is formed; a flat concave-row-supporting portion is disposed integrally on part of an outside of a bottom portion of the fitting concave portion where at least one slider guide portion is formed; the convex-row-meshing portion has an engaging head having a mushroom-shaped or a hook-shaped section; the at least one slider guide portion is provided protrudedly so as to be spaced from the engaging head in a backward direction thereof; and a flat convex-row-supporting portion is disposed integrally on part of an outside of the slider guide portion.

Furthermore, according to the third aspect of the present invention, there is provided a removed portion in which part of the slider guide portion is removed is formed by removing a portion corresponding to a length of a guide flange of the slider so that the convex-row-meshing portion can be inserted through the side of the slider.

Still further, according to the fourth aspect of the present invention, there is provided a slide fastener with an engaging device, wherein the engaging device is provided with a covering portion for covering the concave-row-meshing portion and a nipping portion disposed adjacent to the covering portion for nipping the concave-row-supporting portion, either one of a female fastening member and a male fastening member being disposed at an end portion of the covering portion, while the engaging device is provided with a holding portion for holding the convex-row-meshing portion and a nipping portion disposed adjacent to the holding portion for nipping the convex-row-supporting portion, the other one of the male fastening member and the female fastening member being disposed at an end portion of the holding portion.

Still further, according to the fifth aspect of the present invention, there is provided a slide fastener with an engaging device, wherein the engaging device is provided with the covering portion so as to bury the concave-row-meshing portion therein, while front ends of the concave-row-meshing portion are slightly widely opened.

Still further, according to the sixth aspect of the present invention, there is provided a slide fastener with an engaging device, wherein the engaging device is provided with the covering portion so as to cover three sides of the concave-row-meshing portion except a front side thereof.

Still further, according to the seventh aspect of the present invention, there is provided a slide fastener with an engaging device wherein a shallow groove-like engaged portion, which is slightly expanded as it goes to its bottom, is provided in a front face and a rear face of the covering portion for covering the concave-row-meshing portion, and a protruded engaging portion whose front end is slightly expanded is provided in a front face of the holding portion for holding the convex-row-meshing portion, the engaged portion and the engaging portion being adapted to be engaged with or disengaged from each other.

Still further, according to the eighth aspect of the present invention, there is provided a slide fastener with an engaging device wherein the male fastening member attached with the covering portion of the concave row or the holding portion of the convex row has an engaging protrusion on a flat plate so as to be elastically deformable, and wherein the female fastening member has an engaging hole on a flat plate, into which the engaging protrusion can be fitted.

Still further, according to the ninth aspect of the present invention, there is provided a slide fastener with an engaging device wherein a plurality of through attaching holes are made in a portion, on which the engaging device is to be attached, of each of the concave-row-supporting portion and the convex-row-supporting portion, and the engaging device is molded thereto, via these attaching holes, by injection molding.

Still further, according to the tenth aspect of the present invention, there is provided a slide fastener with an engaging device wherein the engaging device attached to the end portions of the concave row and the convex row is molded of thermoplastic resin integrally, which includes the covering portion and the nipping portion for the concave row, the holding portion and the nipping portion for the convex row, and the female fastening member and the male fastening member, and that the engaging device is fixed to end portions of the concave row and the convex row, namely to the concave-row-supporting portion and convex-row-supporting portion, by being welded or bonded thereto by ultrasonic processing or high-frequency processing.

Still further, according to the eleventh aspect of the present invention, there is provided a slide fastener with an engaging device wherein the engaging device attached to the end portions of the concave row and the convex row is molded integrally using metal, which includes the covering portion and the nipping portion for the concave row, the holding portion and the nipping portion for the convex row, and the female fastening member and the male fastening member, and that the engaging device is fixed to end portions of the concave row and the convex row, namely to the concave-row-supporting portion and convex-row-supporting portion, by being pressed thereto.

Still further, according to the twelfth aspect of the present invention, there is provided a slide fastener with an engaging device wherein the slider attached to the meshing slide fastener for meshing or separating the concave row and the convex row includes a pair of guide flanges making a sliding contact with outer side faces of the concave-row-meshing portion on a side of the concave row and a pair of guide flanges making a sliding contact with an outer side face of a pair of slider guide portions disposed backward of the convex-row-meshing portion on a side of the convex row, while an interval between the guide flanges on the side of the convex row is at least the same as a thickness of the convex-row-meshing portion, so that the convex-row-meshing portion can be passed through the side of the slider between the guide flanges.

DESCRIPTION OF THE EMBODIMENTS

Figure 1:
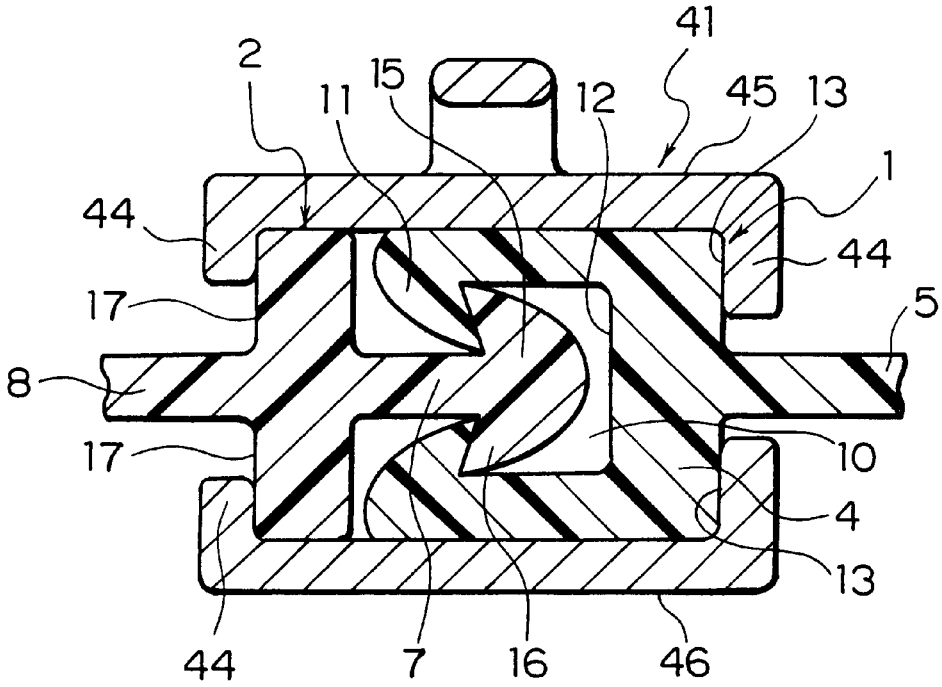
FIG. 1 is a lateral sectional view of a meshing type fastener chain according to a first embodiment of the present invention.

Hereinafter, the embodiments of the meshing type slide fastener with an engaging device according to the present invention will be described in detail with reference to the accompanying drawings.

The meshing type slide fastener of the present invention has a concave row 1 on one side thereof and a convex row 2 on the other side. The concave row 1 is comprised of a concave-row-meshing portion 4 and a concave-row-supporting portion 5. The convex row 2 is comprised of a convex-row-meshing portion 7 and a convex-row-supporting portion 8. The concave row 1 and the convex row 2 are molded in a long belt shape by extruding thermoplastic resin having plasticity such as polyethylene, or polyvinyl chloride, so that the concave row 1 and the convex row 2 can mesh with each other.

According to a first embodiment of the meshing type fastener chain, as shown in FIG. 1, the concave row 1 has a concave-row-meshing portion 4 formed with a pair of hook-shaped engaging pieces 11 whose front ends are directed inward so as to oppose each other. A fitting concave portion 10 is formed between both the engaging pieces 11 for engaging with the convex-row-meshing portion 7. A flat concave-row-supporting portion 5 is provided laterally on part of an outside of a bottom portion 12 of the fitting concave portion 10, for example, in a central portion thereof, so that a pair of slider guide portions 13 for guiding a slider 41 are formed on faces of the bottom portion 12 above and below the concave-row-supporting portion 5.

On the other hand, as shown in FIG. 1, the convex row 2 for meshing with the concave row 1 has a convex-row-meshing portion 7 formed with an engaging head 15 having a mushroom shaped section, which has engaging portions 16 at both front and rear sides of an end of the convex row 2. Then, a pair of slider guide portions 17 for guiding the slider 41 are formed protrudedly on upper and lower faces of a trunk portion of the convex row 2. The slider guide portions 17 are located apart from the engaging head 15 with a space sufficient for the engaging pieces 11 of the concave-row-meshing portion 4 to enter therebetween. Then, a flat convex-row-supporting portion 8 is provided laterally and integrally on part of an outside face of the slider guide portions 17, for example, at a central portion thereof.

The concave row 1 and the convex row 2 are meshed with each other by a sliding action of the slider 41 as shown in FIG. 1. In a body of this slider 41, an upper wing plate 45 and a lower wing plate 46 are joined together by a guide column 42. Guide flanges 44, which make sliding contact with the slider guide portions 13 of the concave row 1 and the slider guide portions 17 of the convex row 2 for guiding them, are provided such that they are bent from both outside edges of the upper wing plate 45 and the lower wing plate 46. Then, the guide flanges 44 on the side of the convex row 2 are formed to have a slightly wider space than the guide flanges 44 on the side of the concave row 1 in their vertical dimensions. For example, the space between the guide flanges 44 on the side of the convex row 2 is formed to be substantially equal to the thickness of the mushroom shaped engaging head 15 of the convex-row-meshing portion 7, so that the convex-row-meshing portion 7 of the convex row 2 can be inserted freely through a side of the slider 41.

Figure 3:
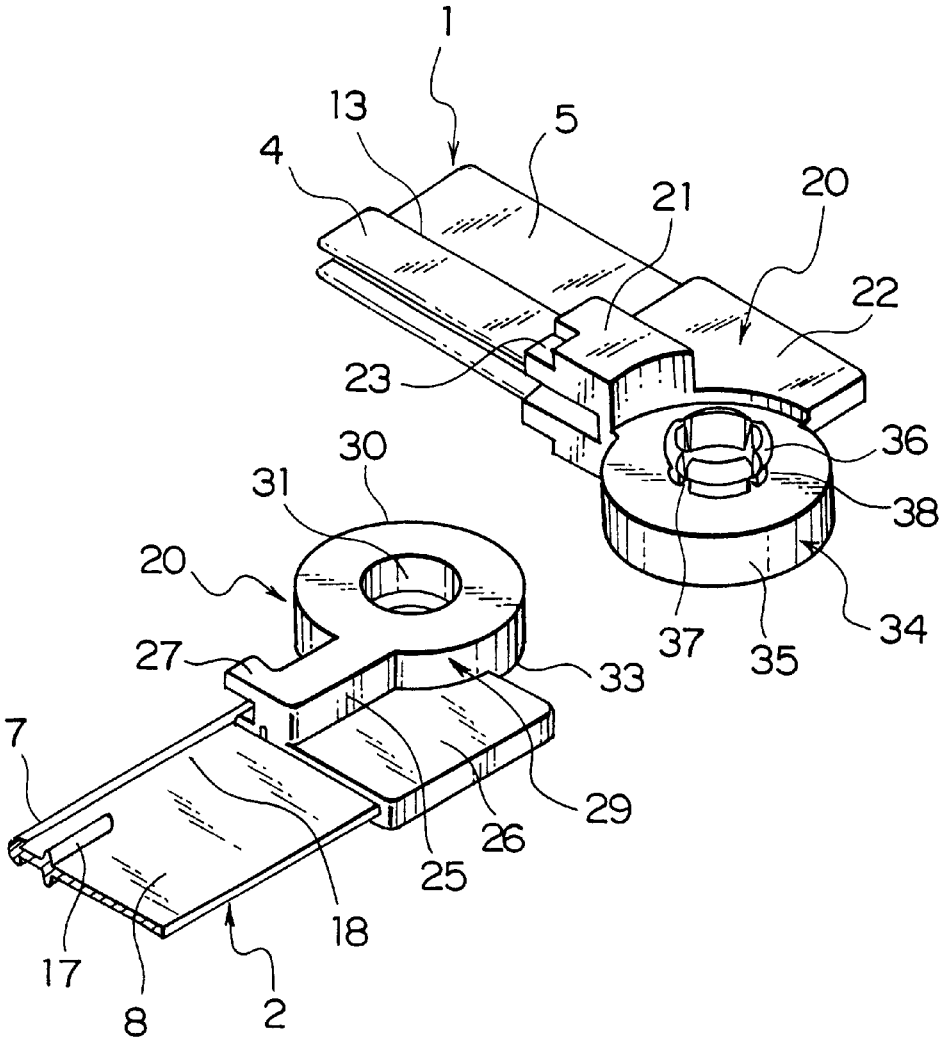
FIG. 3 is a perspective view of major portions of the meshing type slide fastener with an engaging device molded thereto by injection molding.

As shown in FIG. 3, an engaging device 20, which allows the concave row 1 and the convex row 2 to be engaged with and disengaged from each other, is provided at ends of the concave row 1 and the convex row 2 of the meshing type fastener chain. The engaging device 20 is molded integrally and directly to the fastener chain by injection molding using thermoplastic resin such as polyamide, polyacetal, polypropylene, polybutylene terephthalate, or the material of each of these resins mixed with abrasion-resistant-reinforcing material.

Figure 7:
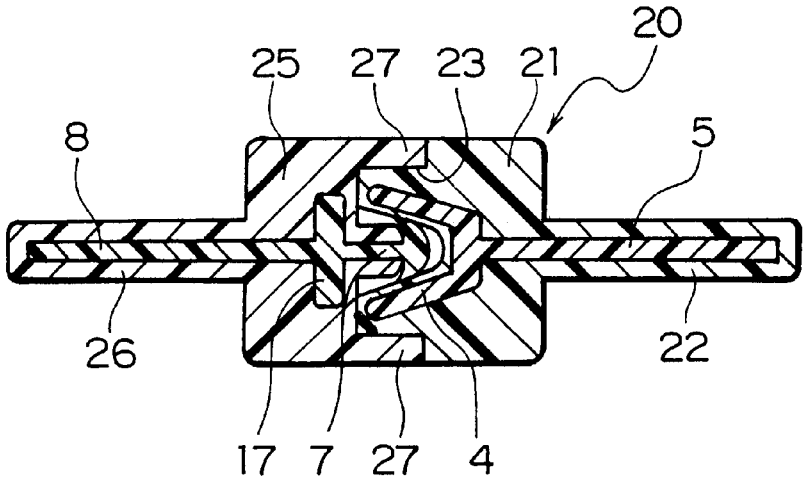
FIG. 7 is a sectional view taken along the line A—A of the meshing type slide fastener in FIG. 6.

As for the molding style, as shown in FIG. 7, the engaging device 20 is molded to the concave row 1 in such a manner that an opening side of the concave-row-meshing portion 4 is slightly widened for allowing the convex-row-meshing portion 7 to enter therein with the hook-shaped engaging pieces 11 being preliminary removed, so as to bury the concave-row-meshing portion 4 and the concave-row-supporting portion 5. Alternatively, it may be molded integrally such that the concave-row-meshing portion 4 and the concave-row-supporting portion 5 are buried with the engaging pieces 11 being tilted inward. Then, a thick covering portion 21 for covering the concave-row-meshing portion 4 entirely is formed. The covering portion 21 is formed with an engaged portion 23, which is a shallow groove narrow on the side of its opening and slightly expanded as it goes to its bottom, in a corner of each of front and rear faces on the side of meshing entrance of the covering portion 21 as shown in FIG. 3. This engaged portion 23 engages with an engaging portion 27 formed on the engaging device 20 on the side of the convex row 2. Further, a thin nipping portion 22 for covering the concave-row-supporting portion 5 is formed adjacent to the covering portion 21.

Figure 8:
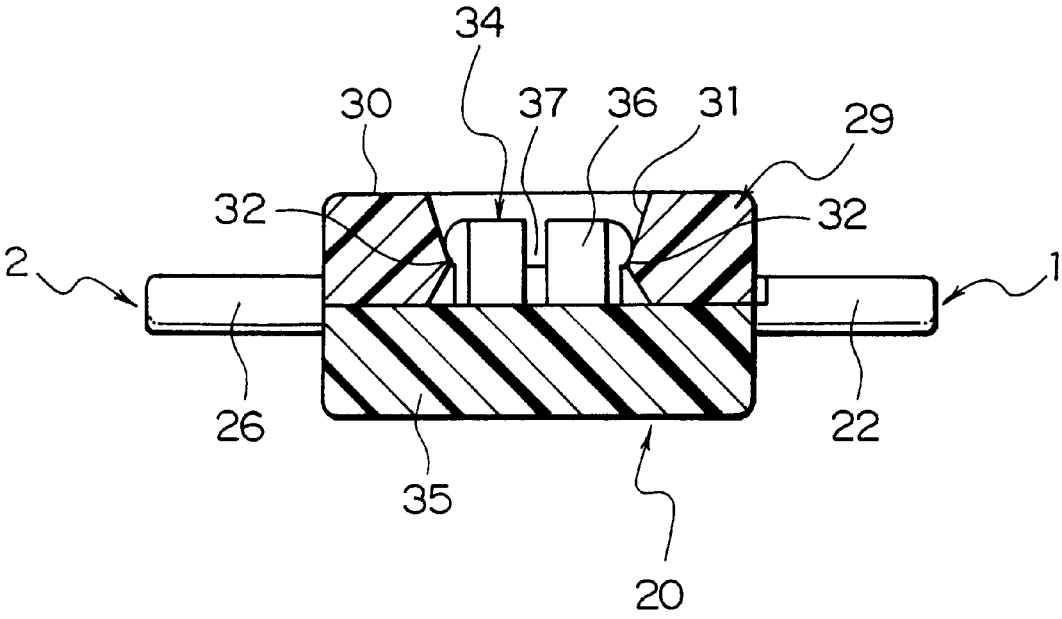
FIG. 8 is a sectional view taken along the line B—B of the meshing type slide fastener in FIG. 6.

A male fastening member 34 is molded integrally with an end portion of the covering portion 21 and a base portion of the nipping portion 22. The male fastening member 34 has, as shown in FIG. 3, a cylindrical engaging protrusion 36 protruded in a center of a flat circular plate 35. This engaging protrusion 36 has a plurality of cut grooves 37 extended in a vertical direction as shown in FIG. 8. Each end portion of the protrusion 36 has a thick rounded edge. Thus, the engaging protrusion 36 can be deformed elastically easily when it is engaged with a female fastening member 29. Meanwhile, an engaging face 38 of the flat plate 35 is disposed substantially in a middle of the thickness direction of the covering portion 21.

When the engaging device 20 is molded on the convex row 2, as shown in FIG. 7, a holding portion 25 is formed for nipping the convex-row-meshing portion 7 extending from a rear face or a rear end of the mushroom shaped engaging head 15 having the engaging portions 16 at both sides thereof up to the slider guide portions 17. The holding portion 25*b* has a thickness equal to that of the covering portion 21 for covering the concave-row-meshing portion 4. As shown in FIG. 3, this holding portion 25 has a protruded engaging portion 27, which is provided at a front face of an end portion of the holding portion 25 and has a front end slightly expanded. When the concave row 1 is meshed with the convex row 2, this protruded engaging portion 27 engages with the engaged portion 23 of the covering portion 21 provided on the engaging device 20 on the side of the concave row 1. Additionally, a thin nipping portion 26 for covering the convex-row-supporting portion 8 is formed adjacent to the holding portion 25.

A female fastening member 29 is molded integrally with an end portion of the holding portion 25 and a base portion of the nipping portion 26. The female fastening member 29 has a circular through engaging hole 31 in a center of a circular flat plate 30 as shown in FIG. 3. A protruded portion 32 is formed in a center of a peripheral wall of the engaging hole 31 such that it is slightly protruded inward as shown in FIG. 8. When the engaging protrusion 36 of the male fastening member 34 is deformed elastically to be engaged with the engaging hole 31, the protruded portion 32 blocks the engaging protrusion 36 of the concave row 1 from escaping. Meanwhile, an engaging face 33 of the flat plate 30 is disposed substantially in a middle of the thickness direction of the holding portion 25. Consequently, the female fastening member 29 can engage with the male fastening member 34 neatly.

If the female fastening member 29 and the male fastening member 34 of the engaging device 20 respectively on the concave row 1 and the convex row 2 may be disposed inversely. For example, the female fastening member 29 is molded integrally with the end portion of the covering portion 21 and the base portion of the nipping portion 22 of the concave row 1 while the male fastening member 34 is formed integrally with the end portion of the holding portion 25 and the base portion of the nipping portion 26 of the convex row 2, in which case an equal function can be secured.

Figure 4:
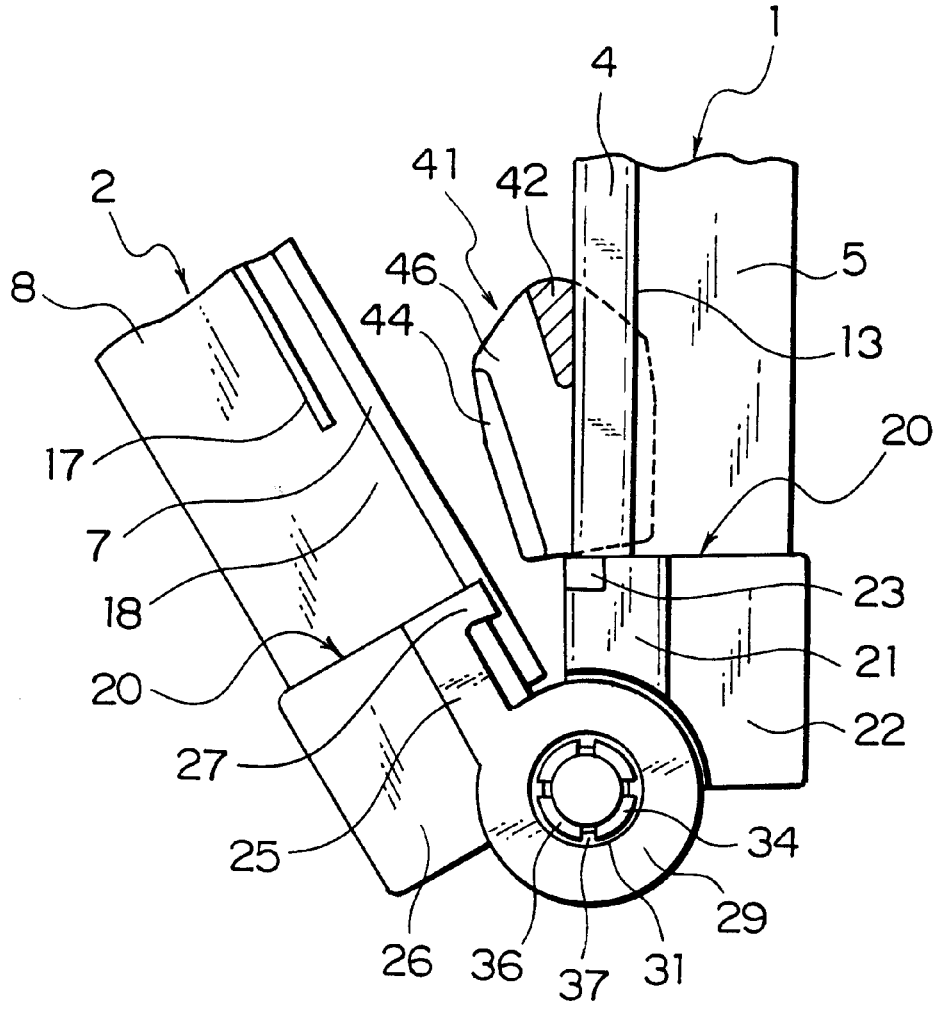
FIG. 4 is an explanatory view showing a concrete state of operation of the meshing type slide fastener.
Figure 5:
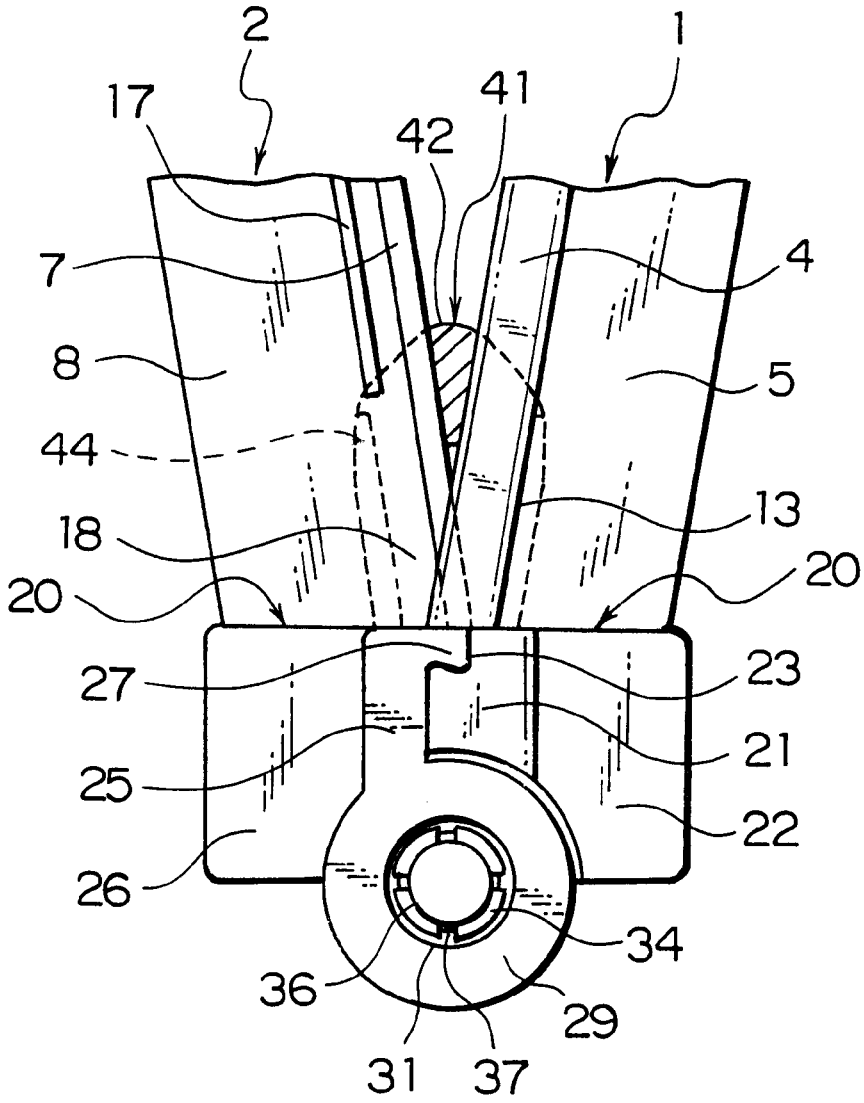
FIG. 5 is an explanatory view showing a concrete state of operation of the meshing type slide fastener.
Figure 6:
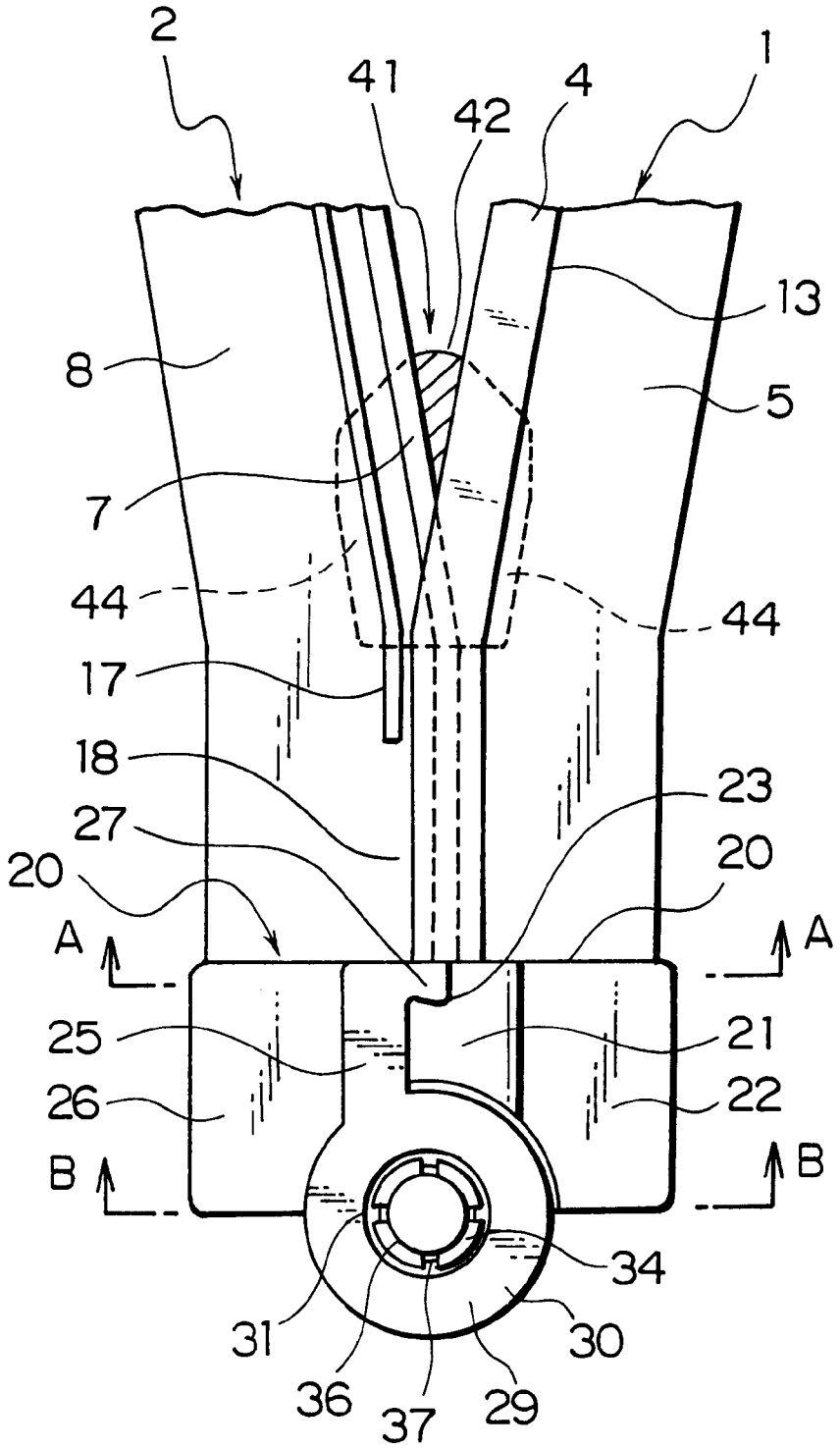
FIG. 6 is an explanatory view showing a concrete state of operation of the meshing type slide fastener.

A usage manner of the concave row 1 and the convex row 2 attached with the engaging device 20 will now be described. As shown in FIGS. 4 to 6, first, a slider 41 is inserted onto the concave-row-meshing portion 4 holding the covering portion 21 of the engaging device 20 and brought into contact with the covering portion 21. After that, the female fastening member 29 disposed on the convex row 2 is engaged with the male fastening member 34 disposed on the concave row 1, and the convex row 2 is rotated in a direction for approaching the concave row 1. At the same time, the convex-row-meshing portion 7 of the convex row 2 and a removed portion 18 in which the slider guide portions 17 are removed are inserted between the guide flanges 44 of the slider 41. Then, the engaging portion 27 formed on the holding portion 25 is pressed into and engaged with the engaged portion 23 formed in the covering portion 21 of the concave row 1. After that, the slider 41 is slid in a direction for closing the slide fastener, so that the concave-row-meshing portion 4 of the concave row 1 is meshed with the convex-row-meshing portion 7 of the convex row 2. Consequently, the meshing type slide fastener can be closed.

To open and separate the closed meshing type slide fastener, the slider 41 is slid to the side of the engaging device 20, and after bringing the slider 41 into contact with the covering portion 21, the convex row 2 and the concave row 1 are pulled in a direction in which they separate from each other with the convex-row-supporting portion 8 being gripped firmly, so that the engaging portion 27 is disengaged from the engaged portion 23. Next, the concave row 1 and the convex row 2 are rotated with respect to the female fastening member 29 and the male fastening member 34 so that the convex-row-meshing portion 7 and the removed portion 18 of the convex row 2 are removed from between the guide flanges 44 of the slider 41. After that, by removing the female fastening member 29 from the male fastening member 34, the concave row 1 and the convex row 2 can be separated from each other.

Figure 2:
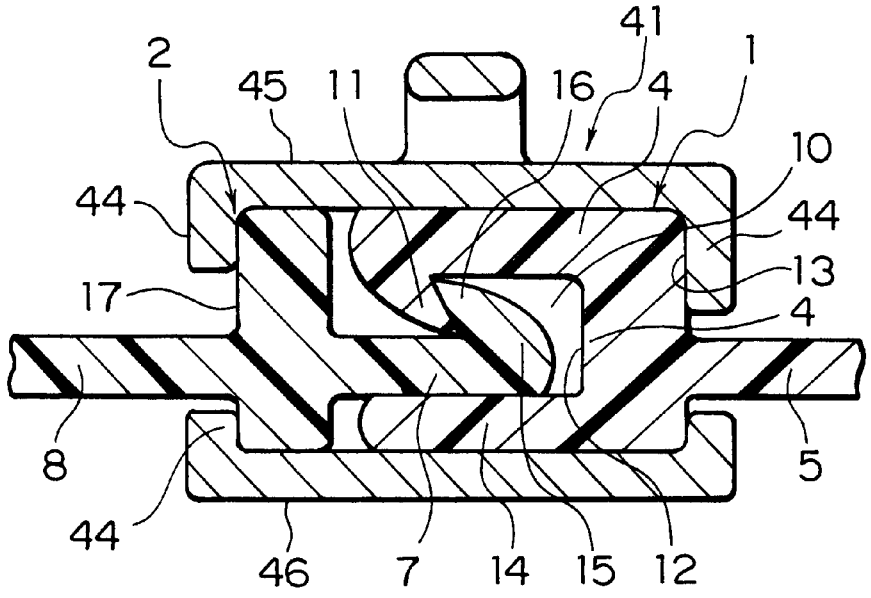
FIG. 2 is a lateral sectional view of a meshing type fastener chain according to a second embodiment of the present invention.

A second embodiment of the meshing type fastener chain will now be described. As shown in FIG. 2, a concave row 1 has a hook-shaped engaging piece 11 whose top end is bent inward, at one side edge thereof, while the other opposing side edge is formed in a shape of a flat tongue-like portion 14 so as to oppose the engaging piece 11. A concave-row-meshing portion 4 is formed with a fitting concave portion 10 capable of fitting to a convex-row-meshing portion 7 between the engaging piece 11 and a tongue piece 14. A flat concave-row-supporting portion 5 is provided laterally on part of the outside of a bottom portion 12 of the fitting concave portion 10, for example, on a portion lower than the central portion thereof, so that slider guide portions 13 for guiding a slider 41 are formed on faces above and below the concave-row-supporting portion 5.

A convex row 2 has, as shown in FIG. 2, a convex-row-meshing portion 7 formed with a hook-shaped engaging portion 16 having an engaging head 15, whose tip end is directed inward so as to oppose the engaging piece 11 of the concave row 1, so that the engaging portion 16 can engage with the engaging piece 11 of the concave row 1. Then, a pair of slider guide portions 17 for guiding the slider 41 are formed protrudedly on upper and lower faces of a trunk portion of the convex row 2. The slider guide portions 17 are located apart from the engaging head 15 with a space sufficient for the engaging pieces 11 of the concave-row-meshing portion 4 to enter therebetween. The top face of the slider guide portion 17 coincides with a top face of the concave-row-meshing portion 4 while the bottom face thereof coincides with the bottom face of the concave-row-meshing portion 4. Then, a flat convex-row-supporting portion 8 is provided laterally on part of the outside face of the slider guide portions 17, for example, a portion coinciding with a position of the concave-row-supporting portion 5.

The slider 41 to be used for this meshing type fastener chain has guide flanges 44 at its upper wing plate 45, one of which is protruded largely on the side of the concave-row-meshing portion 4 while the other is less protruded on the side of the convex-row-meshing portion 7, so as to secure a substantially the same interval as a thickness of the engaging portion 16 of the engaging head 15 of the convex-row-meshing portion 7. Consequently, the engaging head 15 of the convex row 2 can be passed between the guide flanges 44 for insertion or removal. Guide flanges 44 of both sides of a lower wing plate 46 of the slider 41 may be of the same shape.

An engaging device 20 on ends of the concave row 1 and the convex row 2 of this meshing type fastener chain is the same as the engaging device 20 of the first embodiment, so that a description thereof is omitted.

Figure 9:
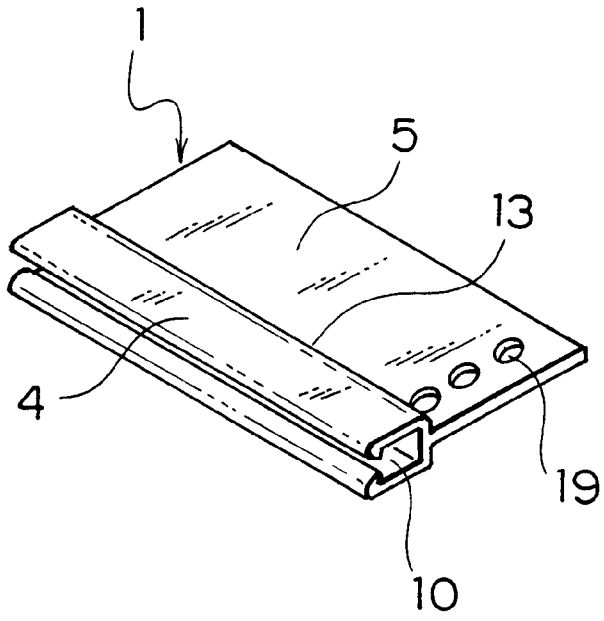
FIG. 9 is a perspective view of a pair of concave and convex rows of another meshing type fastener chain.
Figure 9:
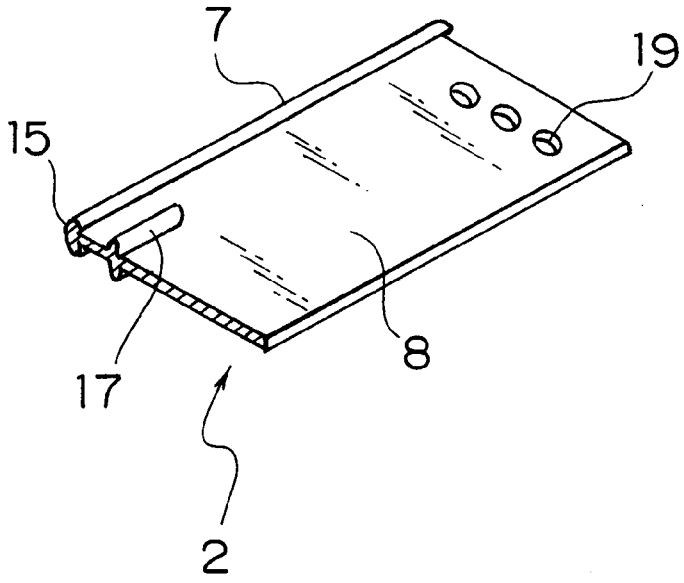

Another embodiment for molding an engaging device 20 at ends of a concave row 1 and a convex row 2 integrally by injection molding will now be described. As shown in FIG. 9, a plurality of through attaching holes 19 are made at each of ends of a concave-row-supporting portion 5 of the concave row 1 and a convex-row-supporting portion 8 of the convex row 2 for injection molding of the engaging device 20. Using the attaching holes 19, the engaging device 20 is molded by injection molding. The molded engaging device 20 is formed such that an upper portion and a lower portion thereof are joined together through the attaching holes 19 so that attaching strength of the engaging device 20 is intensified. As a result, a sturdy meshing type slide fastener with the engaging device can be produced.

Instead of being molded directly at the concave row 1 and the convex row 2 by injection molding in order to attach the engaging device 20 on the ends of the concave row 1 and the convex row 2, the engaging device s 20 may be molded independently by injection molding and then, the concave row 1 and the convex row 2 are inserted into a concave-row-insertion portion 24 and a convex-row-insertion portion 28 of the engaging device 20 so as to be fixed.

Figure 10:
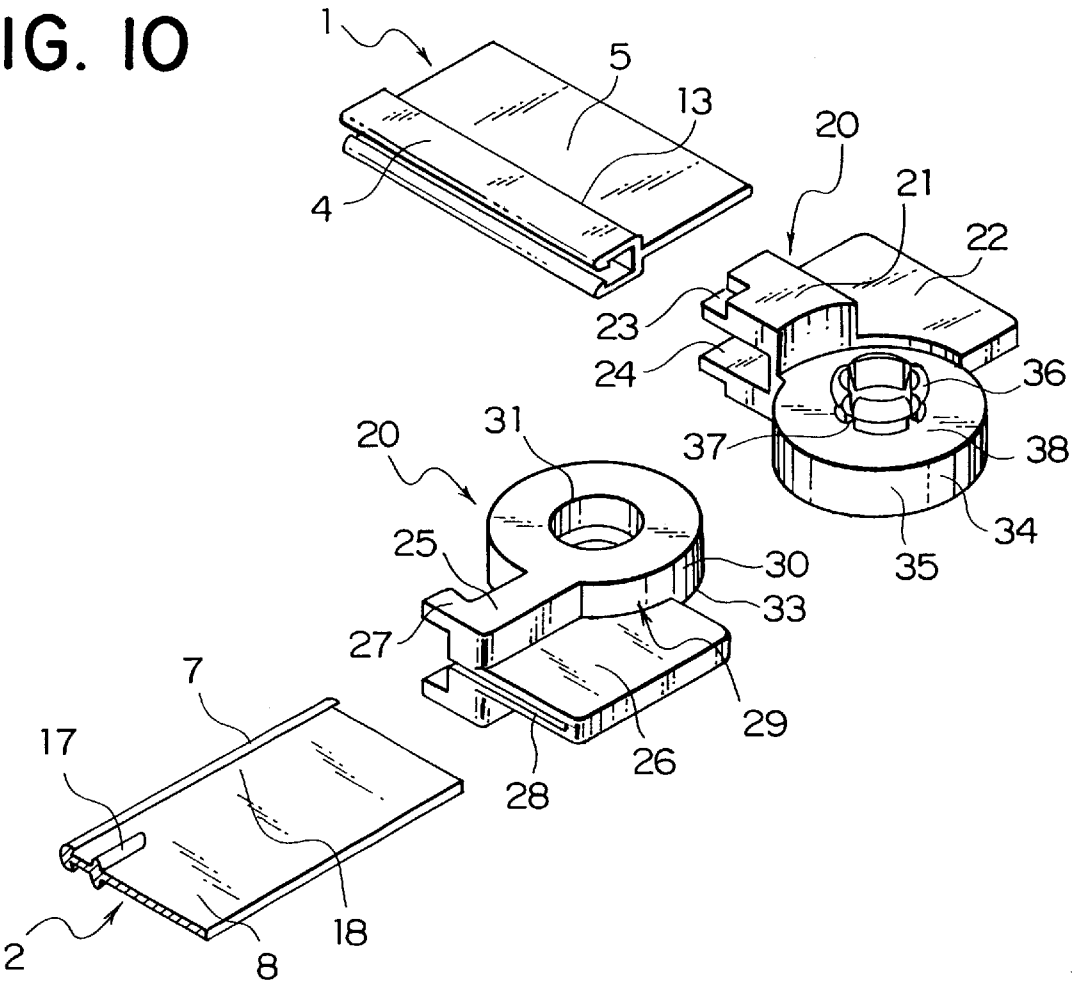
FIG. 10 is a perspective view of a concave row, a convex row and an engaging device of the meshing type slide fastener according to another embodiment of the present invention.
Figure 11:
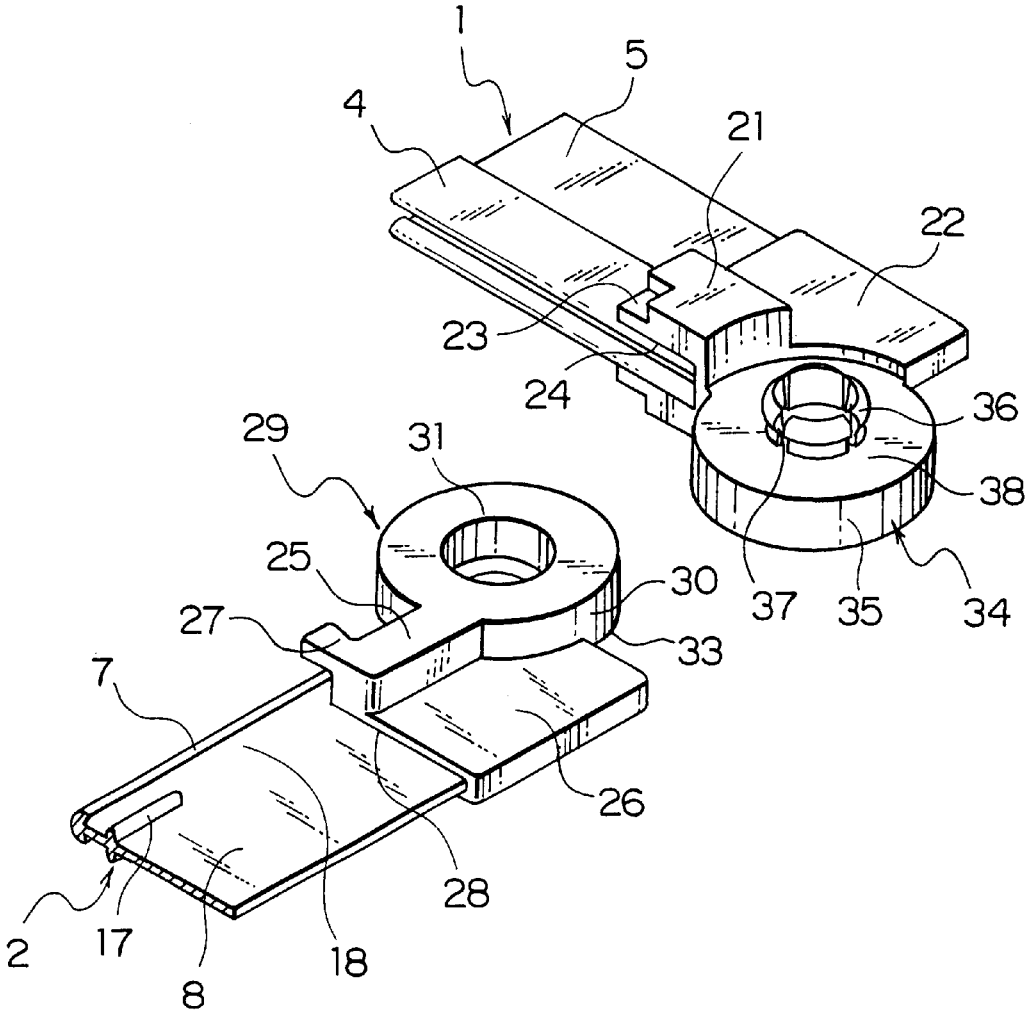
FIG. 11 is a perspective view of major portions of the meshing type slide fastener.

For example, as shown in FIG. 10, the engaging device 20 is molded by injection molding using thermoplastic resin. The concave-row-insertion portion 24 is provided in the engaging device 20 on the side of the concave row 1 such that the concave row 1 can be inserted therein. The concave-row-insertion portion 24 is provided with a thick covering portion 21 in which the concave-row-meshing portion 4 can be inserted, and the covering portion 21 is formed so as to cover three sides of the concave-row-meshing portion 4 except a meshing opening side thereof. Then, a nipping portion 22 is provided laterally adjacent to a rear face of the covering portion 21 so as to nip the concave-row-supporting portion 5 at both an upper face and a lower face of the concave-row-supporting portion 5. A shallow groove-like engaged portion 23 is formed in each of upper and lower faces of the covering portion 21 such that it is narrower to a side of its opening and slightly expanded as it goes to its bottom. When the concave row 1 and the convex row 2 are meshed with each other, the engaged portion 23 is capable of engaging with an engaging portion 27 on a holding portion 25 provided on the convex row 2. Front and rear faces of the covering portion 21 and the nipping portion 22 are linked with each other through a bottom portion of the concave-row-insertion portion 24 and a side face of the nipping portion 22.

Further, a male fastening member 34 is disposed integrally with an end portion of the covering portion 21 and a base portion of the nipping portion 22. The male fastening member 34 has a cylindrical engaging protrusion 36 provided in a center of a circular flat plate 35 thereof, and this engaging protrusion 36 has a plurality of cut grooves 37. Each end of the engaging protrusion 36 has a thick rounded edge. Thus, the engaging protrusion 36 can be deformed elastically easily when it is engaged with a female fastening member 29. Meanwhile, an engaging face 38 of the flat plate 35 is disposed substantially in a middle of the thickness direction of the covering portion 21.

The engaging device 20 on the side of the convex row 2 is provided with a convex-row-insertion portion 28 in which the convex row 2 can be inserted. Then, a removed portion 18 in which a slider guide portion 17 is removed in a predetermined length is provided. A thick holding portion 25 for nipping this removed portion 18 at both upper lower faces thereof is provided. Then, a nipping portion 26 for nipping the convex-row-supporting portion 8 at its upper and lower faces is provided integrally and laterally adjacent a rear face of the holding portion 25. The holding portion 25 has a protruded engaging portion 27, which is provided at a front face of an end portion of the holding portion 25, and a front end of the engaging portion 27 is slightly expanded. When the concave row 1 is meshed with the convex row 2, this engaging portion 27 engages with the engaged portion 23 of the covering portion 21 provided on the engaging device 20 on the side of the concave row 1. Front and rear faces of the holding portion 25 and the nipping portion 26 are linked through a bottom portion of the convex-row-insertion portion 28 and a side face of the nipping portion 26.

A female fastening member 29 is molded integrally with an end portion of the holding portion 25 and a base portion of the nipping portion 26. The female fastening member 29 has a circular through engaging hole 31 in a center of a circular flat plate 30, and a protruded portion 32 is formed in a middle of a peripheral wall of the engaging hole 31 such that it is slightly protruded inward. When the engaging protrusion 36 of the male fastening member 34 is deformed elastically to be engaged with the engaging hole 31, the protruded portion 32 blocks the engaging protrusion 36 of the concave row 1 from escaping. Meanwhile, the engaging face 33 of the flat plate 30 is disposed substantially in a middle of the thickness direction of the holding portion 25.

For attaching the engaging device 20 molded of resin onto the concave row 1 and the convex row 2, as shown in FIGS.

10 and 11, end portions of the concave row 1 and the convex row 2 are inserted into the concave-row-insertion portion 24 and the convex-row-insertion portion 28, respectively, which are provided in the engaging device 20. Then, the nipping portions 22 and 26 of the engaging device 20 are welded to the concave-row-supporting portion 5 and the convex-row-supporting portion 8 by ultrasonic processing or high-frequency processing. Alternatively, the engaging device 20 may be bonded to the concave-row-supporting portion 5 and the convex-row-supporting portion 8 using adhesive agent.

The engaging device 20 to be attached on the end portions of the concave row 1 and the convex row 2 may be molded by die-cast forming means using aluminum alloy or zinc alloy in the same form as mentioned above. By inserting the end portions of the concave row 1 and the convex row 2 into the concave-row-insertion portion 24 and the convex-row-insertion portion 28 formed in the integrally molded engaging device 20 of such metal, the nipping portions 22 and 26 of the engaging device 20 are joined to the concave-row-supporting portion 5 and the convex-row-supporting portion 8 by pressing, respectively. Upon pressing, attention has to be paid not to press and deform the concave-row-meshing portion 4. The structure and operation of the slider using this meshing type fastener chain are the same as that of the meshing type fastener chain of the first embodiment.

Figure 12:
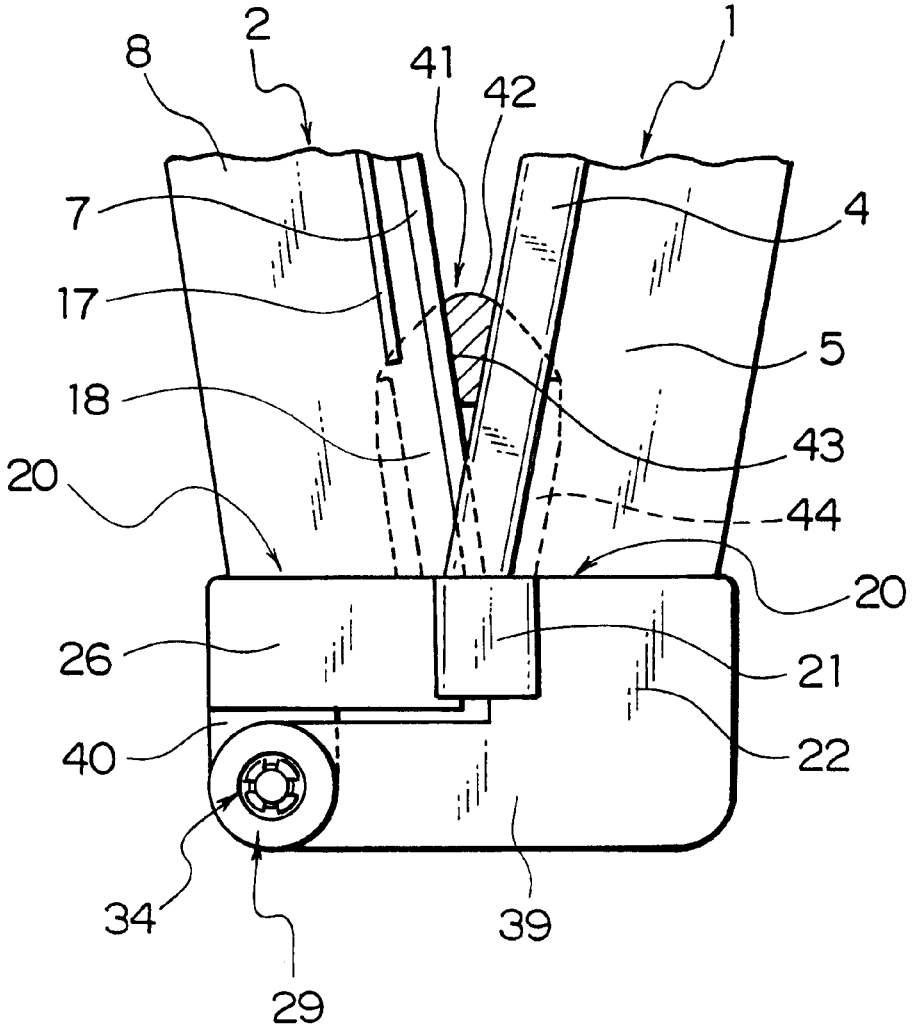
FIG. 12 is an explanatory view showing a concrete state of operation of another meshing type slide fastener.

Finally, an engaging device 20 to be provided on the concave row 1 and the convex row 2 shown in FIG. 12 is different from the structure of the engaging device 20 according to the above described embodiments. The engaging device 20 of a concave row 1 has a covering portion 21 at a lower end of the concave-row-meshing portion 4. Then, a nipping portion 22 for nipping a lower end of the concave-row-supporting portion 5 is provided adjacent to this covering portion 21. This nipping portion 22 has a protruded piece 39, which is provided laterally at the lower end of the nipping portion 22 such that it is protruded to an outer side face of a convex-row-supporting portion 8 via a lower end of the covering portion 21 during the engagement of the device 20. A female fastening member 29 is provided integrally with an end of the protruded portion 39, so that it can engage with a male fastening member 34 provided on the convex row 2.

The engaging device 20 of the convex row 2 has a nipping portion 26 at a lower end of a convex-row-supporting portion 8 and a protruded piece 40, which is protruded vertically downward, is provided on a bottom end of an outer edge of the nipping portion 26. The male fastening member 34 is provided integrally with the protruded piece 40. Consequently, the male fastening member 34 can engage with the female fastening member 29 provided at the concave row 1.

Figure 13:
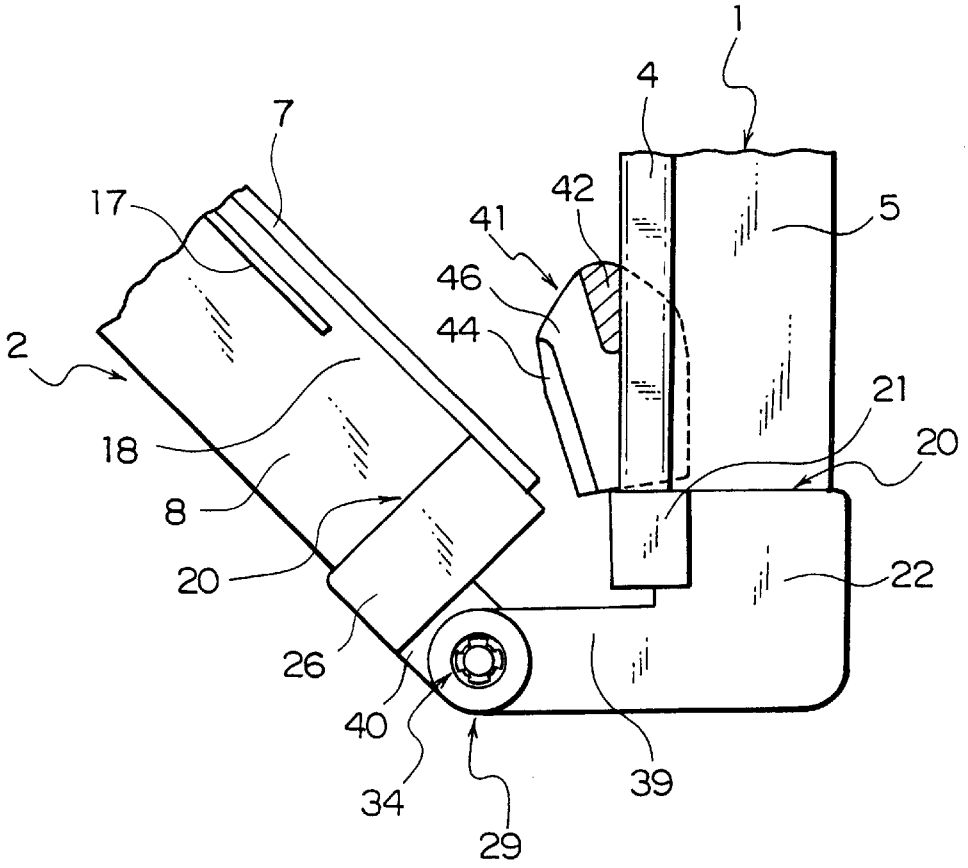
FIG. 13 is an explanatory view showing a concrete state of operation of the meshing type slide fastener.
Figure 14:
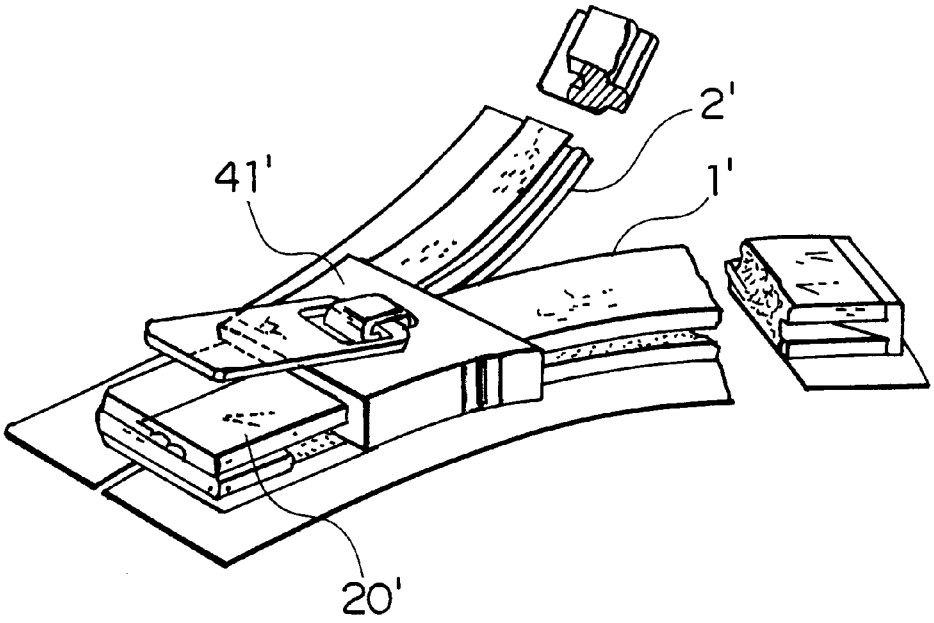
FIG. 14 PRIOR ART
FIG. 14 is a perspective view of a well known meshing type slide fastener.
Figure 15:
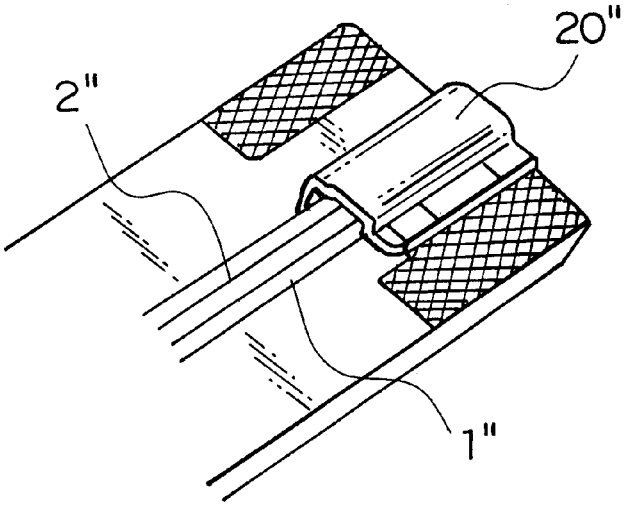
FIG. 15 PRIOR ART
FIG. 15 is a perspective view of major portions of another known separable meshing type slide fastener.

In the engaging device 20 of this embodiment, as shown in FIG. 13, a point where the concave row 1 and the convex row 2 are pivoted by the female fastening member 29 and the male fastening member 34 does not exit on an extension of a line where the concave-row-meshing portion 4 and the convex-row-meshing portion 7 mesh with each other, but is deviated outward of the convex-row-supporting portion 8 from the extension of the meshing line. Therefore, meshing operation is more or less different from the above-described embodiments. First, with the slider 41 kept in contact with a covering portion 21 of the concave-row-meshing portion 4, the male fastening member 34 provided on the protruded piece 40 of the convex-row-supporting portion 8 is engaged with the female fastening member 29 provided on the protruded piece 39 of the concave-row-supporting portion 5. After that,as shown in FIG. 12, a convex-row-meshing portion 7 and a removed portion 18 in which the slider guide portion 17 is removed are inserted between guide flanges 44 of the slider 41, so that the concave-row-meshing portion 4 and the convex-row-meshing portion 7 are meshed with each other. Then, by sliding the slider 41 in a direction for closing the meshing type fastener chain, the meshing type fastener chain is closed.

To open and separate the closed meshing type fastener chain, the slider 41 is slid until it contact the covering portion 21 and then, the convex-row-supporting portion 8 is rotated with respect to the female fastening member 29 and the male fastening member 34 so as to allow the convex-row-meshing portion 7 and the removed portion 18 to remove from the slider 41. After that, by removing the male fastening member 34 from the female fastening member 29, the concave row 1 and the convex row 2 can be separated from each other.

The meshing type slide fastener with an engaging device according to the present invention has the above-described structure. With such a structure, the following effects can be achieved.

According to the first aspect of the present invention, in a slide fastener with an engaging device, which is comprised of a concave row 1 and a convex row 2 made of thermoplastic resin, the concave row 1 and the convex row 2 being meshed with each other, at least one slider guide portion 17 of the convex row 2 at a terminal end of a meshing portion 4, 7 of the concave row 1 and the convex row 2 is removed so that the convex-row-meshing portion 7 is inserted through a side of a slider 41 so as to be engaged with the concave-row-meshing portion 4, while the engaging device 20 for allowing engagement and disengagement of terminal ends of the concave row 1 and the convex row 2 is disposed integrally to the concave row 1 and the convex row 2. Consequently, the concave row 1 and the convex row 2 can be meshed with or separated from each other easily and smoothly by sliding of the slider 41. Further, the convex row 2 can be inserted or removed through a side of the slider 41. Thus, quite a new meshing type slide fastener can be obtained.

Further, according to the second aspect of the present invention, the concave-row-meshing portion 4 has a hook-shaped engaging piece 11 directed inward on tip ends of both sides or on a tip end of a single side thereof so that a fitting concave portion 10 capable of fitting to the convex-row-meshing portion 7 is formed, a concave-row-supporting portion 5 is disposed integrally on an outside of a bottom portion 12 of the fitting concave portion 10 where at least one slider guide portion 13 is formed, the convex-row-meshing portion 7 has an engaging head 15 having a mushroom-shaped or a hook-shaped section, at least one slider guide portion 17 is provided protrudedly so as to be spaced from the engaging head 15 in a backward direction thereof, and a convex-row-supporting portion 8 is disposed integrally on an outside of the slider guide portion 17. Consequently, in addition to the effect of the first aspect of the present invention, this configuration is suitable for a separation-type slide fastener in which the concave row 1 and the convex row 2 can be meshed with each other in a lateral direction, thereby achieving excellent operability and guiding performance.

Furthermore, according to the third aspect of the present invention, a removed portion 18 in which part of the slider guide portion 17 is removed is formed by removing a portion corresponding to a length of a guide flange 44 of the slider 41. Consequently, in addition to the effect of the first or the second aspect of the present invention, the concave row 1 and the convex row 2 can be meshed with each other in a lateral direction, the convex row 2 can be inserted into or removed from between the guide flanges 44 of the slider 41 effectively and easily. Furthermore, the slider 41 can be started smoothly.

Still further, according to the fourth and the fifth aspects of the present invention, the engaging device 20 is molded integrally by injection molding using thermoplastic resin, such that the concave-row-meshing portion 4 and the concave-row-supporting portion 5 are buried in the engaging device 20 with front ends of the concave-row-meshing portion 4 slightly widely opened, either one of a female fastening member 29 and a male fastening member 34 being disposed at an end portion of the concave-row-meshing portion 4, and that the convex-row-meshing portion 7 is buried in a range from a rear end of the engaging head 15 to the convex-row-supporting portion 8, which is also buried in the engaging device 20, the other one of the male fastening member 34 and the female fastening member 29 being disposed at an end portion of the convex-row-meshing portion 7. Consequently, in addition to the effect of the first aspect of the present invention, the engaging device 20 having the female and male fastening members 29, 34, which can be engaged with or separated from each other, at end portions of the concave row 1 and convex row 2 can be molded by injection molding in a single process, thereby facilitating production of the slide fastener with an engaging device and improving productivity.

Still further according to the fourth and the sixth aspects of the present invention, the engaging device 20 is molded such that a covering portion 21 for covering three sides of the concave-row-meshing portion 4 except a front side thereof and a nipping portion 22 for nipping the concave-row-supporting portion 5 adjacent to the covering portion 21 are provided, either one of a female fastening member 29 and a male fastening member 34 being disposed at an end portion of the covering portion 21, and that a holding portion 25 for holding the convex-row-meshing portion 7 and a nipping portion 26 for nipping the convex-row-supporting portion 8 adjacent to the holding portion 25 are provided, the other one of the male fastening member 34 and the female fastening member 29 being disposed at an end portion of the holding portion 25. Consequently, in addition to the effect of the first aspect of the present invention, the concave row 1 and the convex row 2 of the meshing type slide fastener can be engaged with or separated from each other with a simple mechanism, and the engaging device 20 can be attached to the concave row 1 and the convex row 2 by simple means.

Still further, according to the seventh aspect of the present invention, a shallow groove-like engaged portion 23, which is slightly expanded as it goes to its bottom, is provided in a front face and a rear face of the covering portion 21, and a protruded engaging portion 27 whose front end is slightly expanded is provided in a front face of the holding portion 25, the engaged portion 23 and the engaging portion 27 being adapted to be engaged with or disengaged from each other. Consequently, in addition to the effect of the fourth or the fifth aspect of the present invention, when the engaging device 20 attached to the concave row 1 and the convex row 2 are engaged with each other, the engaging device 20 has such an engaging function that prevents itself from being separated from each other easily, thereby facilitating the start of the slider 41.

Still further, according to the eighth aspect of the present invention, the male fastening member 34 has an engaging protrusion 36 on a flat plate 35 so as to be elastically deformable, and that the female fastening member 29 has an engaging hole 31 on a flat plate 30, into which the engaging protrusion 36 can be fitted. Consequently, in addition to the effect of the fourth or the fifth aspect of the present invention, the engaging device 20 can be engaged with or separated from each other smoothly and accurately by means of the female and male fastening members 29, 34 of a simple structure.

Still further according to the ninth aspect of the present invention, a plurality of through attaching holes 19 are made in a portion, on which the engaging device 20 is to be attached, of each of the concave-row-supporting portion 5 and the convex-row-supporting portion 8, and the engaging device 20 is molded thereto by injection molding. Consequently, in addition to the effect of the fourth aspect of the present invention, the engaging device 20 can be attached to the end portions of the concave row 1 and the convex row 2 firmly, so that a highly durable meshing type slide fastener can be obtained.

Still further, according to the tenth aspect of the present invention, the engaging device 20 is molded of thermoplastic resin integrally, which includes the covering portion 21 and the nipping portion 22 for the concave row 1, the holding portion 25 and the nipping portion 26 for the convex row 2, and the female fastening member 29 and the male fastening member 34, and that the engaging device 20 is fixed to end portions of the concave row 1 and the convex row 2 by being welded or bonded to the concave-row-supporting portion 5 and the convex-row-supporting portion 8. Consequently, in addition to the effect of the fifth aspect of the present invention, the engaging device 20 of thermoplastic resin can be attached to the end portions of the concave row 1 and convex row 2 accurately and effectively in a simple manner without obstructing the meshing operation.

Still further, according to the eleventh aspect of the present invention, the engaging device 20 is molded integrally using metal, which includes the covering portion 21 and the nipping portion 22 for the concave row 1, the holding portion 25 and the nipping portion 26 for the convex row 2, and the female fastening member 29 and the male fastening member 34, and that the engaging device 20 is fixed to end portions of the concave row 1 and the convex row 2 by being pressed to the concave-row-supporting portion 5 and the convex-row-supporting portion 8. Consequently, in addition to the effect of the fifth aspect of the present invention, the engaging device 20 made of metal can be attached to the end portions of the concave row 1 and the convex row 2 accurately and effectively in a simple manner without obstructing the meshing operation.

Still further, according to the twelfth aspect of the present invention, the slider 41 includes a pair of guide flanges 44 making a sliding contact with an outer side face of the concave-row-meshing portion 4 on a side of the concave row 1 and a pair of guide flanges 44 making a sliding contact with outer side faces of a pair of slider guide portions 17 disposed backward of the convex-row-meshing portion 7 on a side of the convex row 2, while an interval between the guide flanges 44 on the side of the convex row 2 is at least the same as a thickness of the convex-row-meshing portion 7. Consequently, in addition to the effect of the first or second aspect of the present invention, this slider 41 has a suitable configuration for a meshing slide fastener that allows the concave row 1 and the convex row 2 to be meshed with each other and separated from each other in a lateral direction, thereby ensuring smooth operation. Therefore, the effects, which the present invention can achieve, are very remarkable.

What is claimed:

1. A slide fastener with an engaging device, which is comprised of a concave row and a convex row made of thermoplastic resin, the concave row and the convex row being meshed with each other, wherein part of at least one slider guide portion of the convex row at a terminal end of a meshing portion of the concave row and the convex row is removed, and a removed portion in which said part of the slider guide portion is removed has a length corresponding to a length of a guide flange of a slider, so that the convex-row-meshing portion is inserted through a side of the slider so as to be engaged with the concave-row-meshing portion, while the engaging device for allowing engagement and disengagement of terminal ends of the concave row and the convex row is disposed integrally to the concave row and the convex row.

2. A slide fastener with an engaging device according to claim 1, wherein the concave-row-meshing portion has a hook-shaped engaging piece directed inward on tip ends of both sides or on a tip end of a single side thereof so that a fitting concave portion capable of fitting to the convex-row-meshing portion is formed; a concave-row-supporting portion is disposed integrally on an outside of a bottom portion of the fitting concave portion where at least one slider guide portion is formed; the convex-row-meshing portion has an engaging head having a mushroom-shaped or a hook-shaped section; at least one slider guide portion is provided protrudedly so as to be spaced from the engaging head in a backward direction thereof; and a convex-row-supporting portion is disposed integrally on an outside of the slider guide portion.

3. A slide fastener with an engaging device according to claim 1, wherein the engaging device is provided with a covering portion for covering the concave-row-meshing portion and a nipping portion disposed adjacent to the covering portion for nipping the concave-row-supporting portion, either one of a female fastening member and a male fastening member being disposed at an end portion of the covering portion, while the engaging device is provided with a holding portion for holding the convex-row-meshing portion and a nipping portion disposed adjacent to the holding portion for nipping the convex-row-supporting portion, either the other one of the male fastening member and the female fastening member being disposed at an end portion of the holding portion.

4. A slide fastener with an engaging device according to claim 3, wherein the engaging device is provided with the covering portion so as to bury the concave-row-meshing portion therein, while front ends of the concave-row-meshing portion are slightly widely opened.

5. A slide fastener with an engaging device according to claim 3, wherein the engaging device is provided with the covering portion so as to cover three sides of the concave-row-meshing portion except a front side thereof.

6. A slide fastener with an engaging device according to claim 3, wherein a shallow groove-like engaged portion, which is slightly expanded as it goes to its bottom, is provided in a front face and a rear face of the covering portion, and a protruded engaging portion whose front end is slightly expanded is provided in a front face of the holding portion, the engaged portion and the engaging portion being adapted to be engaged with or disengaged from each other.

7. A slide fastener with an engaging device according to claim 3, wherein the male fastening member has an engaging protrusion on a flat plate so as to be elastically deformable, and wherein the female fastening member has an engaging hole on a flat plate, into which the engaging protrusion can be fitted.

8. A slide fastener with an engaging device according to claim 3, wherein a plurality of through attaching holes are made in a portion, on which the engaging device is to be attached, of each of the concave-row-supporting portion and the convex-row-supporting portion, and the engaging device is molded thereto by injection molding.

9. A slide fastener with an engaging device according to claim 3, wherein the engaging device is molded of thermoplastic resin integrally, which includes the covering portion and the nipping portion for the concave row, the holding portion and the nipping portion for the convex row, and the female fastening member and the male fastening member, and wherein the engaging device is fixed to end portions of the concave row and the convex row by being welded or bonded to the concave-row-supporting portion and the convex-row-supporting portion.

10. A slide fastener with an engaging device according to claim 3, wherein the engaging device is molded integrally using metal, which includes the covering portion and the nipping portion for the concave row, the holding portion and the nipping portion for the convex row, and the female fastening member and the male fastening member, and wherein the engaging device is fixed to end portions of the concave row and the convex row by being pressed to the concave-row-supporting portion and the convex-row-supporting portion.

11. A slide fastener with an engaging device according to claim 1, wherein the slider includes a pair of guide flanges making a sliding contact with an outer side face of the concave-row-meshing portion on a side of the concave row and a pair of guide flanges making a sliding contact with outer side faces of a pair of slider guide portions disposed backward of the convex-row-meshing portion on a side of the convex row, while an interval between the guide flanges on the side of the convex row is at least the same as a thickness of the convex-row-meshing portion.

* * * * *